US006017277A

United States Patent [19]

Chuang

[11] Patent Number: 6,017,277

[45] Date of Patent: Jan. 25, 2000

[54] AIMING DEVICE FOR A BILLIARD CUE

[76] Inventor: Shih-Chuan Lai Chuang, No.20, Dah Yeou 1 Street, Shi Twen Area, Taichung, Taiwan

[21] Appl. No.: 09/240,686

[22] Filed: Feb. 2, 1999

[51] Int. Cl.[7] ..... A63D 15/08

[52] U.S. Cl. ..... 473/44

[58] Field of Search ..... 473/44–49, 2

[56] References Cited

U.S. PATENT DOCUMENTS 4,688,796 8/1987 Wright ..... 473/2
5,554,075 9/1996 Glazer ..... 473/2

FOREIGN PATENT DOCUMENTS 2276825 10/1994 United Kingdom ..... 473/44

*Primary Examiner*—Mark S. Graham
*Attorney, Agent, or Firm*—Bacon & Thomas, PLLC

[57] ABSTRACT

A billiard cue includes a shaft with a tube received in the front end thereof and a ferrule member is engaged with the tube in which batteries are received. The ferrule member has a beam emitting device connected to the front end thereof which has an aperture defined therethrough. A switch is connected to the ferrule member and electrically connected to the beam emitting device. A tip is attached to the distal end of the beam emitting device and has a passage defined therethrough which is in alignment with the aperture.

4 Claims, 3 Drawing Sheets

AIMING DEVICE FOR A BILLIARD CUE

FIELD OF THE INVENTION

The present invention relates to a cue, and more particularly, to a cue having a beam emitting device received in the front end thereof so as to emit a beam through the tip on the front end of the cue to assist to aim the ball.

BACKGROUND OF THE INVENTION

A conventional cue for the billiards is generally composed by a shaft portion and a tip which is attached to the front end of the shaft portion so as to hit the ball. The player has to hit the white ball to impact the color balls such as the red balls in a snooker game to let the color balls fall into the pockets. During the game, the white ball, the color ball and the pocket may not located in alignment with each other so that the white ball is expected to hit the color ball at the impact point not passing through the center of the color ball so that the color ball will move along a direction different from that of the cue hits the white ball. In order to precisely control the direction of the color ball the position on the color ball at which the white ball hits is important. Generally, this requires much experiences to practice again and again. Actually, even the experienced player could miss the right point to be hit on the color ball. For a player having not much experiences, it will be helpful if the billiard cue has an aiming device so that the player can precisely aim the ball so as to hit the desired point on the ball. By the aiming device, the player is able to check his/her aiming immediately by the aiming device so as to reduce the time to find out the correct aiming way. Furthermore, it is difficult for the coach or the director for teaching the player to mark a note on the ball to guide the player to hit the point.

The present invention intends to provide a billiard cue which has a beam emitting device received in the front end thereof so as to emit a beam through the tip to assist the player to aim the ball.

The present invention provides a simple and an effective way to improve the aiming of the ball such that the drawbacks of the conventional billiard cue can be resolved.

SUMMARY OF THE INVENTION

In accordance with one aspect of the present invention, there is provided a billiard cue comprising a shaft having a recess defined in the front end thereof for receiving a tube therein which has a close first end and an open second end. A ferrule member has a neck extending from the first end thereof so as to be engaged with the open second end of the tube and a beam emitting device is connected to the second end thereof An aperture is defined in the distal end of the beam emitting device and a switch is connected to the ferrule member and electrically connected to the beam emitting device. A tip is attached to the distal end of the beam emitting device and has a passage defined therethrough which is in alignment with the aperture.

It is an object of the present invention to provide an aiming device for the billiard cue wherein a beam is emitted from the passage in the tip so as to assist the player to aim the balls.

Further features of the present invention will become apparent after a careful reading of the detailed description with appropriate reference to the accompanying drawings.

BRIEF DESCRIPTION OF THE DRAWINGS

FIG. I is an exploded view of the billiard cue in accordance with the present invention.

DETAILED DESCRIPTION OF THE PREFERRED EMBODIMENT

Figure 1:
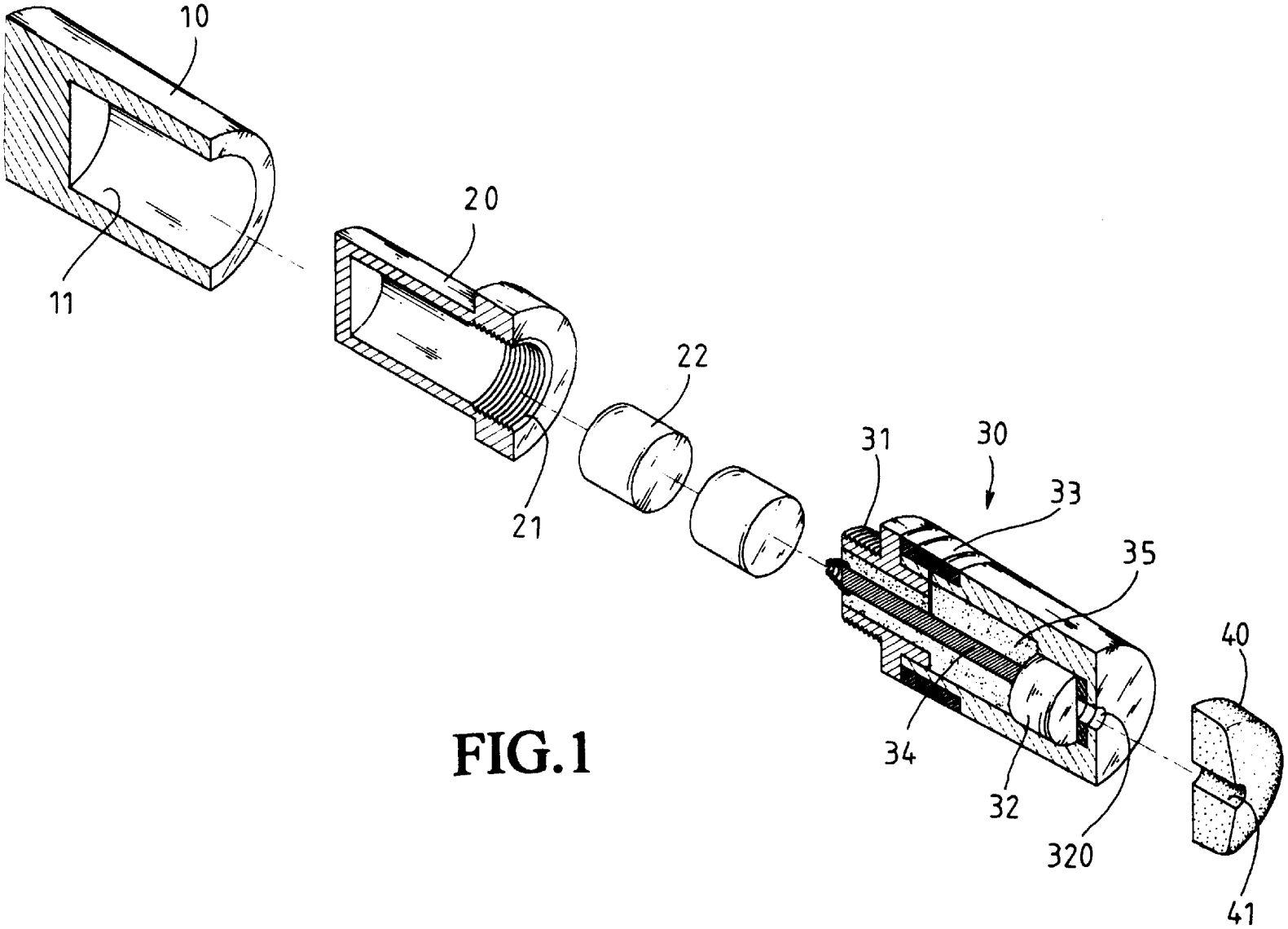
Figure 2:
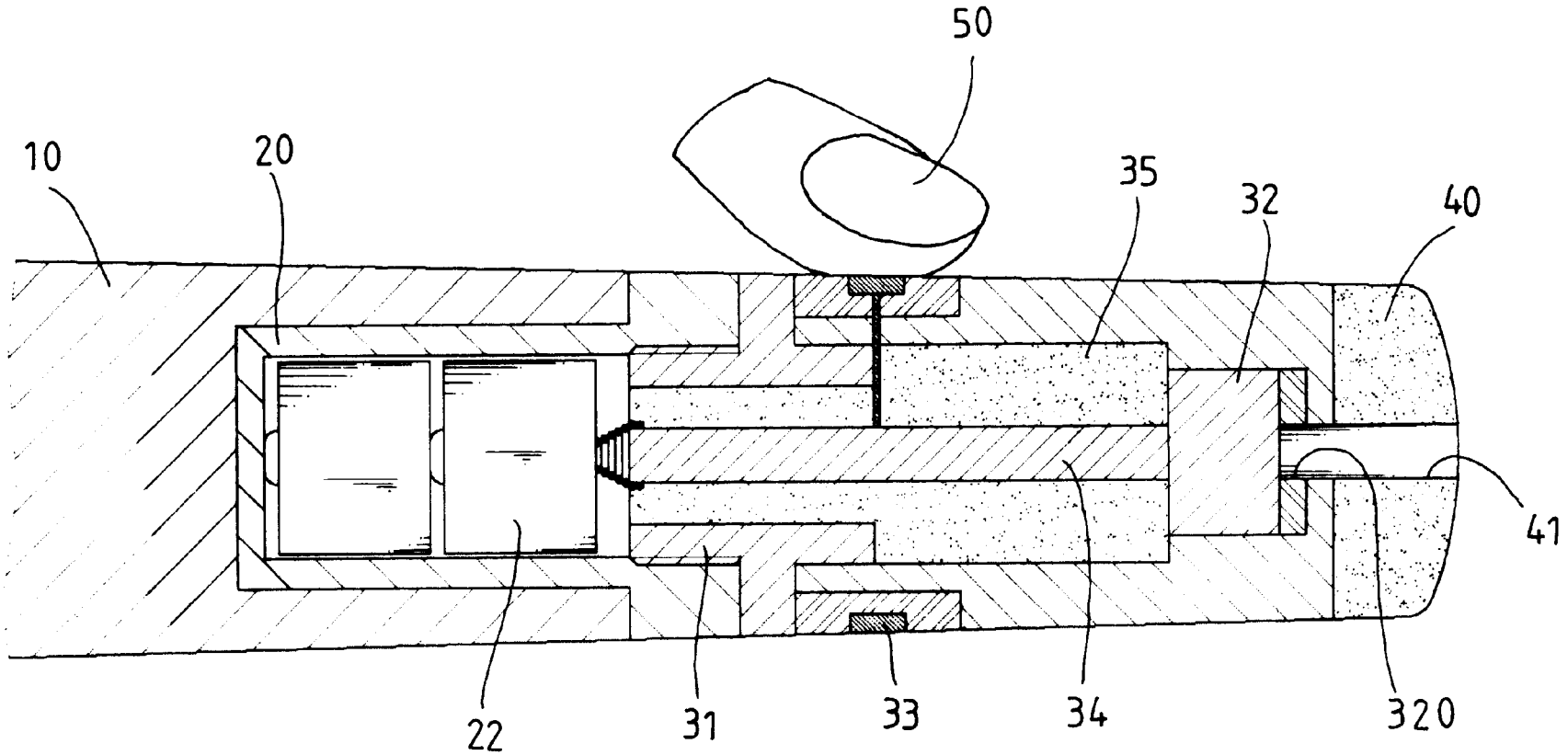
FIG. 2 is a side elevational view, partly in section, of the aiming device in the billiard cue of the present invention.

Referring to FIGS. I to 3, the billiard cue comprises a shaft 10 having a recess 11 defined in the front end thereof and a tube 20 received in the recess 11, wherein the tube 20 is designed to receive the batteries 22. The tube 20 has a close first end and an open second end which has a threaded portion 21 defined in the inner periphery thereof.

Figure 3:
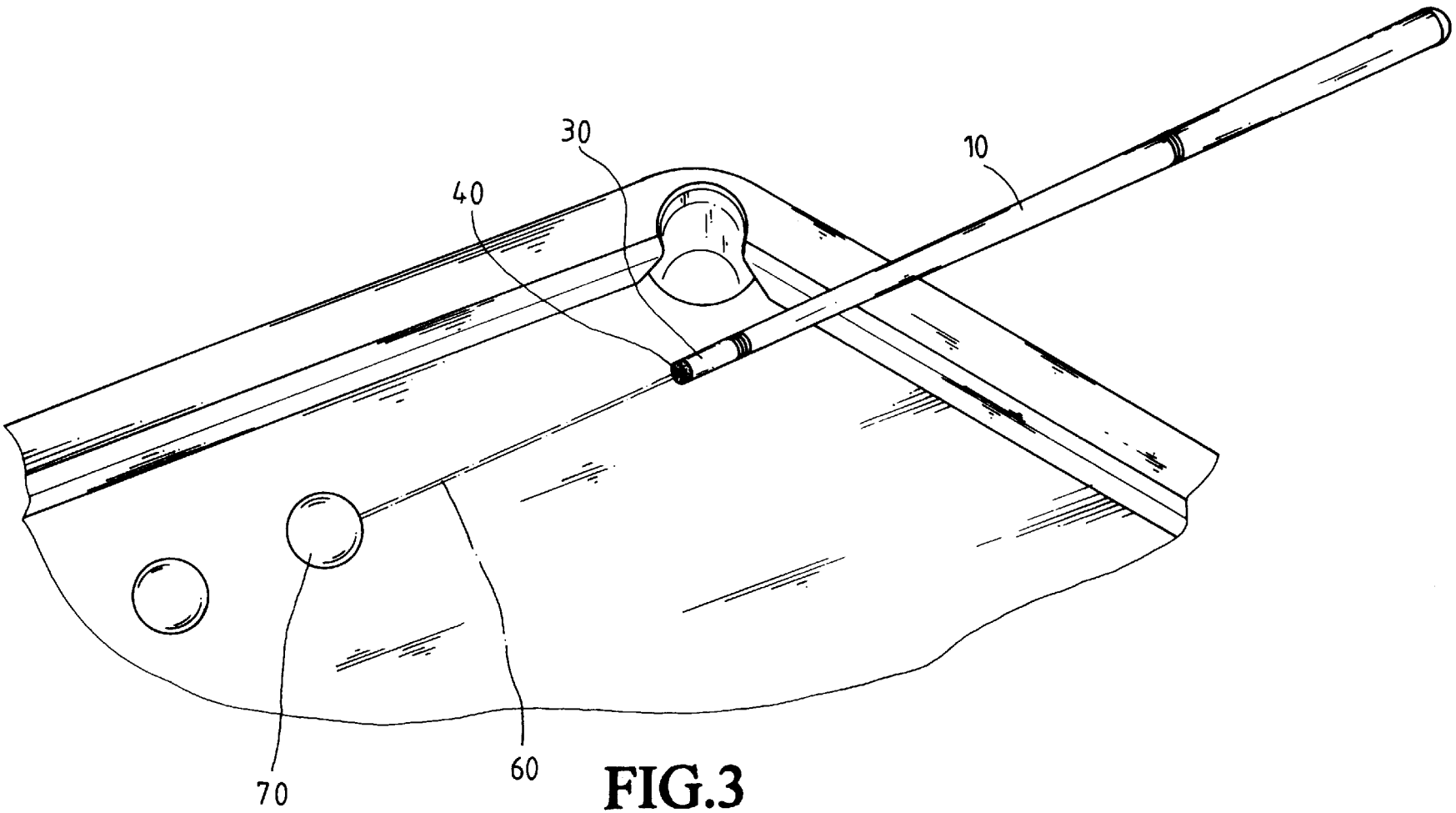
FIG. 3 is an illustrative view to show the beam emitted from the aiming device of the present invention and aiming on a ball.

A ferrule member 30 has a neck 31 extending from the first end thereof and has a threaded outer periphery so as to engage with the threaded portion 21 of the tube 20. A beam emitting device 32 is connected to the second end of the ferrule member 30 and an aperture 320 is defined in the distal end of the beam emitting device 32. A tip 40 is attached to the distal end of the beam emitting device 32 and has a passage 41 defined therethrough which is in alignment with the aperture 320. A switch 33 is connected to the ferrule member 30 and an integrated circuit board 34 is received in the ferrule member 30. The integrated circuit board 34 is electrically connected between the switch 33 and the beam emitting device 32 so that when the user's finger 50 touches the switch 33 once, a beam 60 (FIG. 3) is generated from the beam emitting device 32 and passes through the aperture 320 and the passage 41 of the tip 40.

In order to protect the integrated circuit board 34 from being disengaged from the switch 33 or the beam emitting device 32, a shock absorbing stuff 35 is received in the ferrule member 30 and encloses the integrated circuit board 34 so that when hitting the ball 70 (FIG. 3), the integrated circuit board 34 is not affected.

Accordingly, the user may touch the switch 33 to aim the beam 60 to the ball 70 to be hit so as to hit the specific point on the ball 70. Furthermore, when the switch 33 is touched twice, the beam 60 disappears. It is convenient for the coach or the director for teaching the player to keep marking the desired impact point by using another beam emitting device 32 to let the player to practice hitting the ball 70 at the correct point. Also, the beam emitting device 32 can be used to indicate the precise banking angle or the predicted position where the ball 70 will be so as to arrange the next shoot.

It is to be understood that the above description and drawings are only used for illustrating some embodiments of the present invention, not intended to limit the scope thereof. Any variation and derivation from the above description and drawings should be included in the scope of the present invention.

What is claimed is:

1. A billiard cue comprising:

a shaft having a recess defined in a front end thereof and a tube received in said recess, said tube having a closed first end and an open second end;

a ferrule member having a neck extending from a first end thereof so as to be engaged with said open second end of said tube and a beam emitting device connected to a second end thereof, an aperture defined in a distal end of said beam emitting device, a switch connected to said ferrule member and electrically connected to said beam emitting device, and a tip attached to the distal end of said beam emitting device and having a passage defined therethrough which is in alignment with said aperture.

2. The billiard cue as claimed in claim 1, wherein the open second end of said tube has a threaded portion defined in the inner periphery thereof and said neck has a threaded outer periphery so as to engage with said threaded portion of said tube.

3. The billiard cue as claimed in claim 1 further comprising an integrated circuit board received in said ferrule member and electrically connected between said switch and said beam emitting device.

4. The billiard cue as claimed in claim 3 further comprising shock absorbing stuff received in said ferrule member and enclosing said integrated circuit board.

* * * * *